US006581352B1

(12) United States Patent
Amirsoleymani

(10) Patent No.: US 6,581,352 B1
(45) Date of Patent: Jun. 24, 2003

(54) CONCRETE COMPOSITE STRUCTURAL SYSTEM

(76) Inventor: Kamran Amirsoleymani, 8650 E. El Chorro La., Scottsdale, AZ (US) 85250

( * ) Notice: Subject to any disclaimer, the term of this patent is extended or adjusted under 35 U.S.C. 154(b) by 0 days.

(21) Appl. No.: 09/927,051

(22) Filed: Aug. 9, 2001

Related U.S. Application Data

(60) Provisional application No. 60/226,062, filed on Aug. 17, 2000.

(51) Int. Cl.[7] ..... E04C 2/04

(52) U.S. Cl. ..... 52/602; 52/309.17; 52/405.3

(58) Field of Search ..... 52/596, 602, 603, 52/784.14, 793.1, 364, 576, 311.1, 309.17, 405.1, 405.3; 405/286

(56) References Cited

U.S. PATENT DOCUMENTS

| | | | | | |
|---|---|---|---|---|---|
| 775,562 | A | * | 11/1904 | Golliek | 138/148 |
| 1,495,896 | A | * | 5/1924 | Ferguson | 52/275 |
| 2,805,448 | A | * | 9/1957 | Rubenstein | 174/52.2 |
| 3,438,312 | A | | 4/1969 | Becker et al. | |
| 3,495,367 | A | * | 2/1970 | Kobayashi | 52/223.6 |
| 3,922,413 | A | * | 11/1975 | Reineman | 264/129 |
| 3,940,891 | A | | 3/1976 | Slysh | |
| 4,012,549 | A | | 3/1977 | Slysh | |
| 4,015,653 | A | | 4/1977 | Slysh et al. | |
| 4,067,156 | A | * | 1/1978 | Downing, Jr. | 52/126.6 |
| 4,116,258 | A | | 9/1978 | Slysh et al. | |
| 4,151,872 | A | | 5/1979 | Slysh et al. | |
| 4,619,433 | A | | 10/1986 | Maier | |
| 4,648,223 | A | | 3/1987 | Richard | |
| 4,942,707 | A | * | 7/1990 | Huettemann | 264/32 |
| 5,433,049 | A | * | 7/1995 | Karlsson et al. | 52/169.11 |
| 5,566,520 | A | | 10/1996 | Branitzky | |
| 5,596,870 | A | * | 1/1997 | Dillard et al. | 60/752 |
| 5,787,654 | A | | 8/1998 | Drost | |
| 5,806,264 | A | | 9/1998 | Boot | |
| 5,888,608 | A | | 3/1999 | Tsai | |
| 5,950,390 | A | | 9/1999 | Jones | |
| 5,992,106 | A | | 11/1999 | Carling et al. | |
| 6,064,352 | A | * | 5/2000 | Silverman et al. | 343/897 |
| 6,230,465 | B1 | * | 5/2001 | Messenger et al. | 52/309.14 |

FOREIGN PATENT DOCUMENTS

| | | | | |
|---|---|---|---|---|
| FR | 925937 | * | 4/1947 | 52/602 |
| FR | 1473268 | * | 3/1967 | 52/602 |
| FR | 2456182 | * | 1/1981 | 52/602 |
| GB | 713145 | * | 8/1954 | 52/602 |

* cited by examiner

*Primary Examiner*—Carl D. Friedman
*Assistant Examiner*—Brian E. Glessner
(74) *Attorney, Agent, or Firm*—Frank J. McGue

(57) ABSTRACT

A structural panel is formed of an isogrid web. The structural panel has a flat face covering one open side of the isogrid web and four sidewalls forming the edges of the isogrid web, The flat face and the sidewall form, in combination, an open topped box like structure. The isogrid web has a first plurality of ribs oriented vertically thereby providing columnar support for the structural panel and a second plurality of nibs oriented transversely at an angle to the first plurality of ribs thereby providing lateral support for the structural panel. The first plurality of ribs and the second plurality of ribs form, in combination, a pattern of repeating isosceles triangles thereby forming the isogrid web. The first plurality of ribs and the second plurality of ribs meet at a third plurality of nodes forming the vertices of the isosceles triangles.

11 Claims, 1 Drawing Sheet

CONCRETE COMPOSITE STRUCTURAL SYSTEM

RELATED APPLICATION

This application is a continuation of provisional application serial no. 60/226,062 filed Aug. 17, 2000.

TECHNICAL FIELD

This invention, named Trigrid™, relates generally to the field of structural elements, and, more specifically, to concrete composite wall and floor systems utilizing a specific geometrical pattern of triangular ribs known as isogrid.

BACKGROUND OF THE INVENTION

The isogrid pattern, as a proven concept, has been known to the aircraft industry for many years. Its origin is credited to famed British aircraft designer Barnes Wallis for its use in the Lancaster four engine heavy bomber which performed in World War II.

Formed out of machined metal alloys, isogrid has also been used in aerospace vehicle components in various forms such as the floor partition on the Skylab space station, the tank skin of the Saturn S-IV rocket and the Titan payload shroud. It was also adapted as the baseline structural concept for Rockwell's space station payload interface. However, since the aerospace applications require special metal and highly sophisticated and costly machinery to manufacture, such applications have not been suitable for non-aerospace applications.

The isogrid structure employs upstanding ribs which are integral with a sheet material arranged in a series of abutting isosceles triangles. Some variations use equilateral triangles. Examples of the uses of isogrid structures is found in many patents, for example, U.S. Pat. Nos. 4,015,653, 4,116,258 and 4,141,872 entitled "Panel Deployment System", "Panel Deployment and Retraction System" and "Panel Deployment System", respectively, which issued on Apr. 5, 1977, Sep. 26, 1978 and May 1, 1979, respectively, to Slysh et al. disclose a panel of an extremely light isogrid structure comprised of a plurality of grid members arranged in a pattern of contiguous isosceles triangles and joined at their corners by circular nodes.

U.S. Pat. No. 3,940,891 entitled "Conical Structure" which issued on Mar. 2, 1976 to Slysh is one of the early patents utilizing an isogrid reinforcing structure.

U.S. Pat. No. 4,012,549 entitled "High Strength Composite Structure" which issued on Mar. 15, 1977 to Slysh discloses a high strength composite structure utilizing an isogrid of equilateral triangles.

In the present construction industry, wood panels, typically plywood, are used to construct buildings and the like. Such wood panels typically require weather sealing by, for example, Tyvek® film, to prevent warpage and; the like in wet conditions. There are other disadvantages to the use of wood, ranging from the environmental concerns, the high cost of forest products and the need for columns and beam materials to provide support for the construction.

In contrast, concrete has been suggested as an alternative material for structural panels. For example, U.S. Pat. No. 5,566,520 entitled "Integrated Precast Concrete Forming System" which issued on Oct. 22, 1996 to Branitzky shows precast concrete wall modules having reinforcing members and providing that the modules can be available in panels such as 8×8, 8×16, etc.

U.S. Pat. No. 5,950,390 entitled "Pre-Cast Concrete Building Module" which issued on Sep. 14, 1999 to Jones provides a pre-cast concrete building module having reinforcing ribs and cavities to cause the module to be lighter.

U.S. Pat. No. 5,806,264 entitled "Multi-Cellular Wall Structure" which issued on Sep. 15, 1998 to Boot discloses a prefabricated reinforced wall structure having a concrete grid and having a layer of cement render on both sides. The render is a mixture of Portland cement and suitable aggregate and offers considerable bracing support for concrete grid 4 in the form of a surface skin that has significant compressive and in some case tensile capacities.

There have been some uses of isogrid panels in some construction uses. For example, U.S. Pat. No. 5,787,654 entitled "Isogrid Tile" which issued on Aug. 4, 1998 to Drost shows an isogrid tile of equilateral triangles which may be used for flooring assemblies.

U.S. Pat. No. 5,992,106 entitled "Hexagon Tile with Equilateral Reinforcement" which issued on Nov. 30, 1999 to Carling et al. provide another tile for floor covering utilizing an isogrid of equilateral triangles.

U.S. Pat. No. 5,888,608 entitled "Composite Grid/Frame Structures" which issued on Mar. 30, 1999 to Tsai discloses an isogrid element which may be used for concrete reinforcement. Col. 9, lines 5–7 mention that the reinforcing system is generic and can be applied to housing.

However, none of the known prior art disclose the combination set forth herein.

SUMMARY OF THE INVENTION

It is an object of this invention to provide a concrete composite, Trigrid structurale panel, for use in the construction industry.

It is an further object of this invention to provide a new lightweight structural panel that can be mass produced, easily transported to site and erected in place as a complete wall providing a method for attaching objects or panels such as drywall thereto.

It is still another object of this invention to provide a new improved structural panel which can be formed with a variety of finished exterior textures and colors ready to install.

It is yet another object of this invention to form such a panel in a curvature form so when attached together they would form a lightweight concrete tube or storage tank.

Further objects and advantages of the invention will become apparent as the following description proceeds and the features of novelty which characterize this invention will be pointed out with particularity in this specification.

BRIEF DESCRIPTION OF THE DRAWINGS

The present invention may be more readily described by reference to the accompanying drawings in which.

DESCRIPTION OF THE PREFERRED EMBODIMENTS

Figure 1:
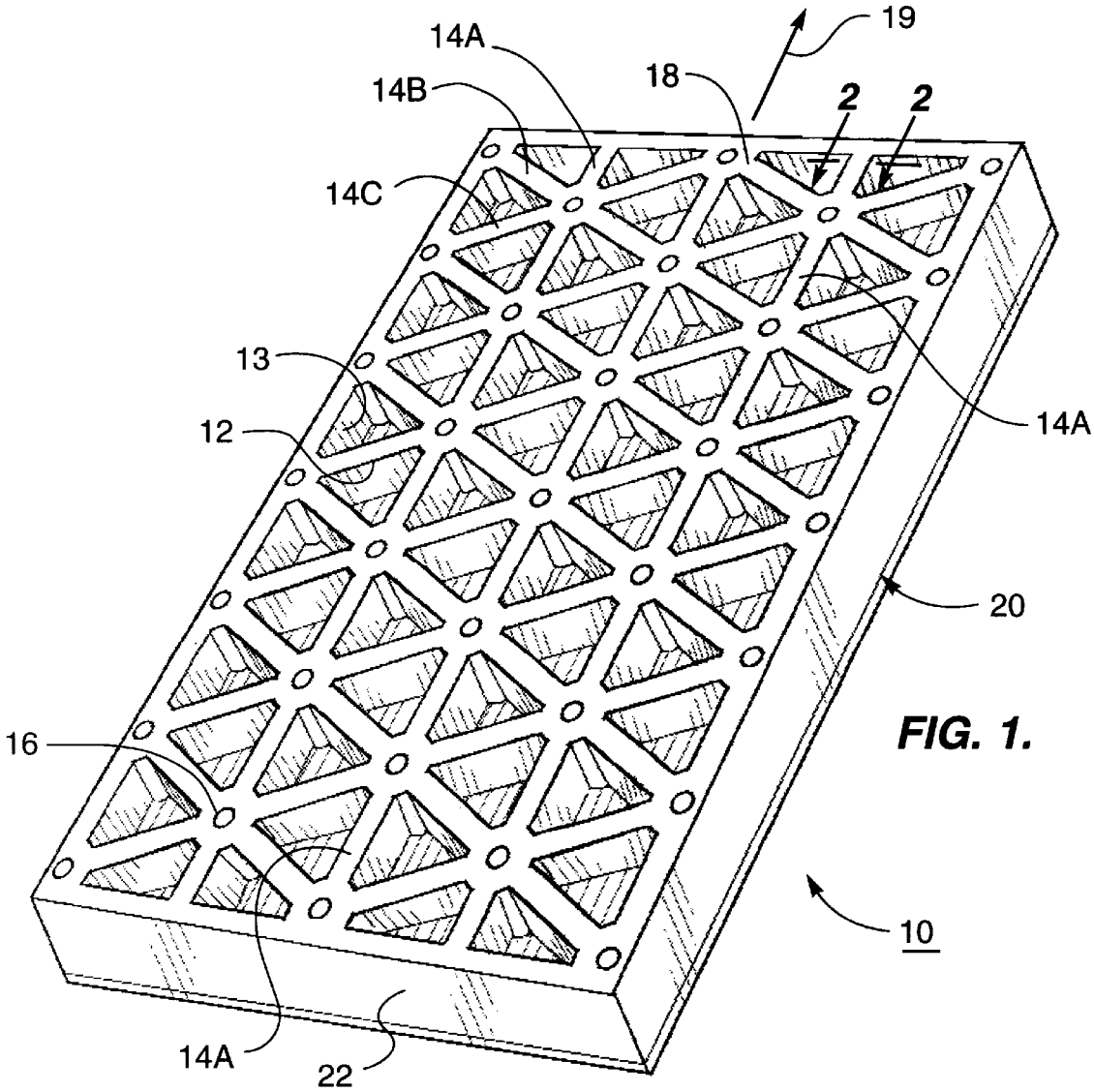
FIG. 1 is a perspective view of the present invention in a flat form.
Figure 3:
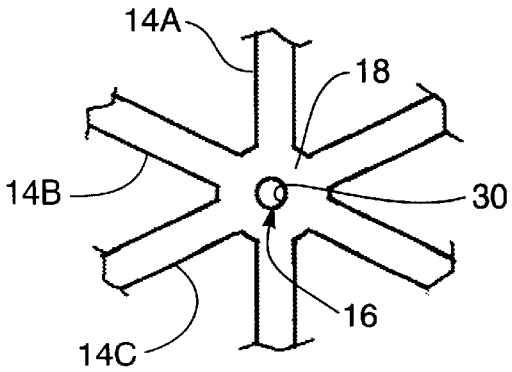
FIG. 3 is a top view of an intersection of isosceles triangles where attachment points for other objects are made.
Figure 2:
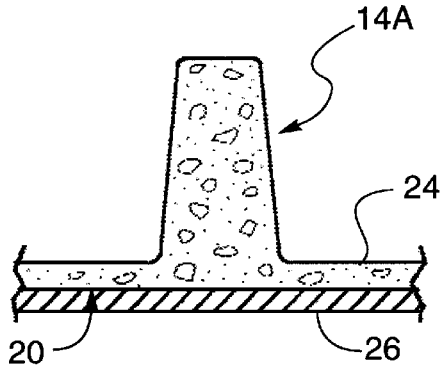
FIG. 2 is a cross sectional side view of the present invention taken along lines 2—2 of FIG. 1.

Referring more particularly to the drawings by characters of reference, FIGS. 1–3 disclose combinations of features which constitute the components of a structural panel 10 of the present invention. As seen in FIG. 1, panel 10 comprises an isogrid web 12 is formed from a plurality of ribs 14A, 14B and 14C (hereinafter collectively "ribs 14") which meet at nodes 16, a flat face 20 covering one open side of isogrid web 12 and four sidewalls 22 forming the edges of panel 10. Flat face 20 and sidewalls in combination form an open topped box like structure having ribs 14A–C contained therein. The interstices 13 of web 12 can be left empty or filled with, for example, insulating material.

Ribs 14A are oriented in a vertical direction indicated by arrow 19 to provide columnar support to the panel. Ribs 14B and 14C are transversely oriented at an angle to ribs 14A to the vertical to provide lateral support to the panel. Panel 10 is, preferably, manufactured in a variety of sizes'such as 4 feet ×8 feet or 4 feet ×6 feet though, of course, any size desired can be employed. In addition, curved variations of panel 10 are contemplated.

As best seen in FIG. 2, flat face 20 is preferably two layers, an upper layer 24 integral with ribs 14 and a surface panel 26. In the presently preferred embodiment, upper layer 24 and ribs 14 are comprised of an aggregate mixture of concrete, selected gravel aggregate and void material, preferably lightweight balls comprised of molded and sealed paper products. The concrete provides a strong resistance to compression, the gravel aggregate provides a strong tensile strength while the void material reduces the weight of the construction.

The presently preferred paper balls are well known in the art and are typically newspaper which is molded into spheres when wet, then dried and sealed with a thin paraffin coating when dry. Effectively, the use of a composition mixture forms a reticular structure without discontinuities for strength yet is lightweight due to the incorporation of the balls. Concrete aggregate compositions are well known in the art and are available commercially.

It will be understood by those skilled in the art that other void materials such as foam products can be utilized in the concrete aggregate mixture. In addition, certain strengthening additives can be added to the concrete to .enhance the strength of same. Lastly, certain reinforcing materials can be employed with the present invention including, but not limited to, rebar, wire mesh, pecil rod, other fabrics and fiberglass.

In the preferred embodiment, surface panel 26 is manufactured of the same concrete as flat face 24 but without the additives. This provides a smoother surface for decoration such as paint to be applied.

As best seen in FIG. 3, nodes 16 are surrounded by a rib 18 which is generally circular in cross section. At the axis of rib 18, an insert 30 is provided for easy attachment of drywall, fixtures, picture hangers and the like during construction or afterwards, by a homeowner. Insert is simply a hole which can be fiber filled if desired. An appropriate sized screw, nail or bolt (not shown) is used to attach virtually anything which comprises a hole having fiber inserted therein. In addition, the panels can easily be drilled if necessary.

In one embodiment, nodes 16 are separated vertically along ribs 14A by about 16 inches and horizontally, as measured on sidewalls 22, by about 12 inches. In that configuration, the base of each isosceles triangle, formed along ribs 14A, is 16 inches while the sides formed along ribs 14B and 14C are about 14½ inches long. Ribs 14 are about 1½ inches wide and extend upwardly from flat face 20 by about 3½ inches while flat face 20 is about 1 inch thick. Note that these dimensions are for purposes of illustration only, and those skilled in the art will recognize that many other configurations are possible.

To manufacture panel 12 simply requires the construction of appropriate molds to hold the wet aggregate and cement until set. Once the molds are constructed, panels 12 can be manufactured as desired. At the construction site, panels 12 can be attached to one another via the use of mortar on sidewalls 22 or via U-shaped brackets (not shown). Of course, panels 12 can also be sawn with an appropriate concrete saw to the right size. In addition, insulating material can be added to interstices 13 or drywall attached thereto at the site.

Although only certain embodiments have been illustrated and described, it will be apparent to those skilled in the art that various changes and modifications may be made therein without departing from the spirit of the invention or from the scope of the appended claims.

That which is claimed is:

1. A structural panel comprising an integrally formed isogrid web, a flat face covering one open side of the isogrid web and four sidewalls forming the edges of the isogrid web, the flat face and the sidewalls forming, in combination, an open topped box like structure, the isogrid web having a first plurality of ribs only oriented vertically, each of the first plurality of ribs extending between opposing sidewalls, the first plurality of ribs thereby providing columnar support for the structural panel, a second plurality of ribs oriented at an angle to the first plurality of ribs, a first half of the second plurality of ribs having the angle measured clockwise from the first plurality of ribs, a second half of the second plurality of ribs having the angle measured counterclockwise from the first plurality of ribs, each of the second plurality of ribs extending between sidewalls, the second plurality of ribs thereby providing lateral support for the structural panel, the first plurality of ribs and the second plurality of ribs forming, in combination, a pattern of repeating isosceles triangles thereby forming the isogrid web, the first plurality of ribs and the second plurality of ribs meeting only at a third plurality of nodes, each of the third plurality of nodes comprising a juncture of one of the first plurality of ribs, one of the first half of the second plurality of ribs and one of the second half of the second plurality of ribs, the isogrid web comprising an aggregate mixture of concrete, selected gravel aggregate and void material.

2. The structural panel of claim 1 wherein the flat face is comprised of an upper layer integral with the first and second plurality of ribs and a surface panel covering the upper layer.

3. The structural panel of claim 2 wherein the upper layer and the first and second plurality of ribs are comprised of an aggregate mixture of concrete, selected gravel aggregate and void material.

4. The structural panel of claim 3 wherein the void material comprises lightweight balls comprised of molded and sealed paper products.

5. The structural panel of claim 4 wherein the lightweight balls are comprised of paper molded into a spherical shape and sealed with a thin paraffin coating.

6. The structural panel of claim 3 wherein the surface panel is comprised of the same concrete mixture as the flat face without additives to provide a smooth surface for decoration.

7. The structural panel of claim 1 wherein each of the third plurality of nodes is a circle having a center axis, the center axis having an insert mounted thereon.

8. The structural panel of claim 1 adapted to be attached to another structural panel by mortar.

9. The structural panel of claim 1 wherein each of the repeating isosceles triangles is empty.

10. A structural panel comprises an integrally formed isogrid web and a flat face covering one open side of the isogrid web and four sidewalls forming the edges of the isogrid web, the flat face and the sidewall forming, in combination, an open topped box like structure, the isogrid web comprising a first plurality of ribs only oriented vertically, each of the first plurality of ribs extending continuously between opposing sidewalls, the first plurality of ribs thereby providing columnar support for the structural panel, a second plurality of ribs oriented at an angle to the first plurality of ribs, a first half of the second plurality of ribs having the angle measured clockwise from the first plurality of ribs, a second half of the second plurality of ribs having the angle measured counterclockwise from the first plurality of ribs, each of the second plurality of ribs extending continuously between sidewalls, the second plurality of ribs thereby providing lateral support for the structural panel, the first plurality of ribs and the second plurality of ribs forming, in combination, a pattern of repeating isosceles triangles thereby forming the isogrid web, the isogrid web comprising an aggregate mixture of concrete, selected gravel aggregate and void material, the first plurality of ribs and the second plurality of ribs meeting only at a third plurality of nodes forming the vertices of said repeating isosceles triangles, each of the third plurality of nodes comprising a juncture of one of the first plurality of ribs, one of the first half of the second plurality of ribs and one of the second half of the second plurality of ribs, each of the third plurality of nodes being a circle having a center axis, the center axis having an insert mounted thereon, the flat face being comprised of an upper layer integral with the first and second plurality of ribs and a surface panel covering the upper layer, the upper layer and the first and second plurality of ribs being comprised of an aggregate mixture of concrete, selected gravel aggregate and void material, the void material comprising lightweight balls comprised of molded and sealed paper products, the surface panel being comprised of the same concrete mixture as the flat face without additives to provide a smooth surface for decoration.

11. The structural panel of claim 10 wherein the lightweight balls are comprised of paper molded into a spherical shape and sealed with a thin paraffin coating.

* * * * *